United States Patent [19]

Tempel et al.

[11] Patent Number: 4,834,548

[45] Date of Patent: May 30, 1989

[54] APPARATUS FOR AGITATING THE CONTENT OF A CLOSED PACKAGE

[75] Inventors: Aleksander Tempel, Vällingby; Börge Sörensen, Hägersten, both of Sweden

[73] Assignee: Skandex AB, Stockholm, Sweden

[21] Appl. No.: 30,488

[22] Filed: Mar. 27, 1987

[51] Int. Cl.[4] ..... B01F 9/00

[52] U.S. Cl. ..... 366/208; 366/217; 366/219

[58] Field of Search ..... 366/208, 209, 213, 214, 366/215, 217, 219, 220, 233, 305; 248/652; 74/86

[56] References Cited

U.S. PATENT DOCUMENTS

| | | | |
|---|---|---|---|
| 1,755,763 | 4/1930 | Barber | 366/217 |
| 3,809,322 | 5/1974 | Hirosawa | 241/46.17 |
| 4,235,553 | 11/1980 | Gall | 366/208 |
| 4,345,843 | 8/1982 | Berglund et al. | 366/219 |
| 4,497,581 | 2/1985 | Miller | 366/208 |

FOREIGN PATENT DOCUMENTS

| | | | |
|---|---|---|---|
| 0025535 | 2/1985 | Japan | 366/219 |

*Primary Examiner*—Harvey C. Hornsby

*Assistant Examiner*—Christine A. Peterson

*Attorney, Agent, or Firm*—Burns, Doane, Swecker & Mathis

[57] ABSTRACT

An apparatus for mixing the content of a closed package, such as a paint can. The apparatus comprises a frame and a substantially vertically oriented package holder which is movably mounted in the frame. The package holder includes a device for releasably clamping a package so that the axis of the package is parallel with the axis of the holder. The apparatus also includes a device for driving the holder in a closed movement path relative to the frame. The drive device comprises a rotatable shaft which is substantially vertically oriented and which is mounted centrally on the frame. The drive shaft carries a crank having a substantially vertical pin. The pin is centrally connected to the lower portion of the holder and is journalled at one of its ends into a rolling bearing. Stabilizing devices connect the holder and the frame and are arranged to prevent relative rotation between the holder and the frame around the drive shaft axis. The holder is mounted such that its axis converges toward the drive shaft axis in the direction toward the upper portion of the holder.

8 Claims, 2 Drawing Sheets

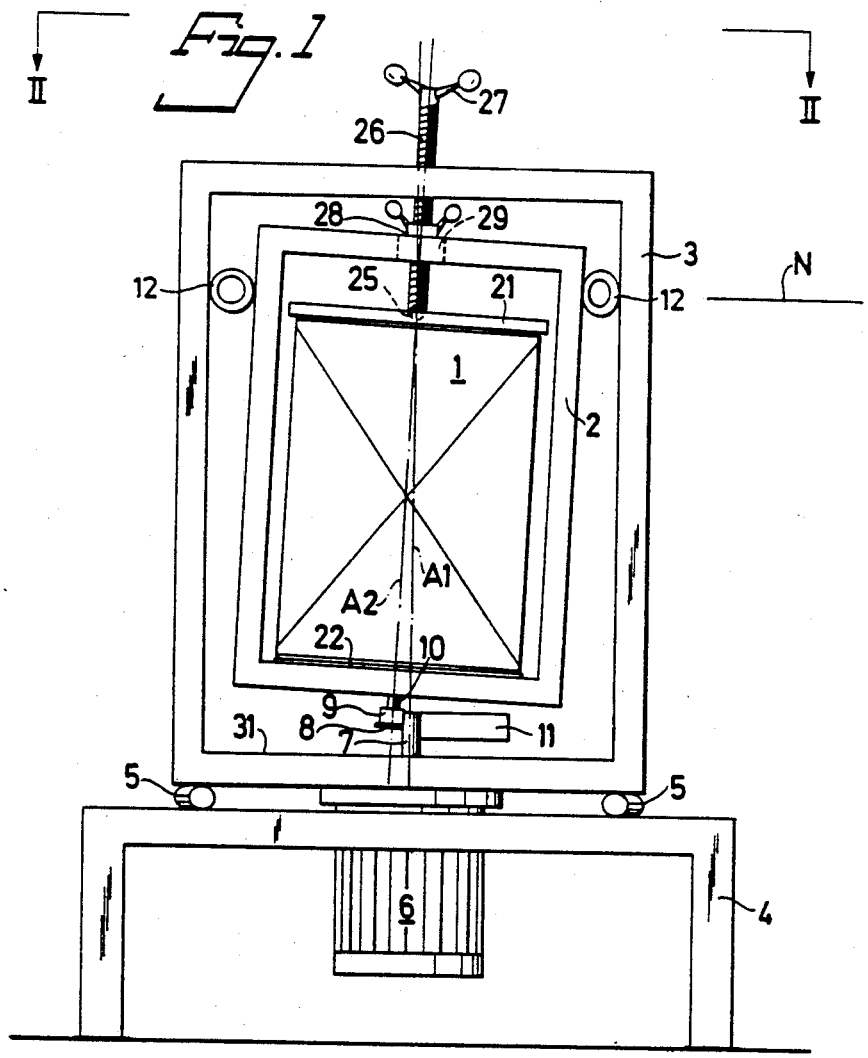
Fig. 1
II
II
27
26
28
29
3
N
12
25
21
12
1
2
A1
A2
22
10
9
31
8
7
11
5
5
6
4
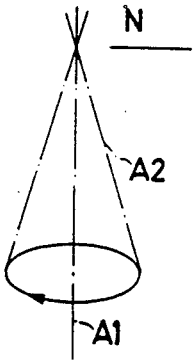
N
A2
A1

APPARATUS FOR AGITATING THE CONTENT OF A CLOSED PACKAGE

TECHNICAL FIELD

The invention refers to an apparatus for agitating the content of a closed package, such as a paint container, said apparatus comprising a frame, a container holder which is substantially vertically oriented and movably mounted on the frame, said holder comprising means for releasable clamping of differently sized containers in the holder, and means for driving the holder related to the frame in a closed movement path with a rotational speed of at least 100 rpm. An apparatus of said type is previously known from GB 1,586,953.

The invention finds specific use for mixing or agitation of paint in closed containers, and in the following, for the sake of simplicity, the invention will be described in connection with this field of use, but it should be clear that the invention also finds use for other materials and other packages.

BACKGROUND

Colour is usually delivered in thin-walled cans or containers. These cans have often been stored for such a long time or in such an environment, that one or more of the components of the colour separates or sediments in the can. Furthermore it can be desired to tint the delivered colour to a certain nuance before use. Nowadays such tinting is often made by addition of predetermined amounts of predetermined tinting colours to the delivered base paint, which has a precisely set nuance, and the result will be a well predeterminable colour nuance.

In said examples, the content of the can must be carefully agitated or mixed before the paint can be used for a painting operation.

The paint content of the can container can of course be homogenized or mixed thereby that the lid is taken or from the can, and the paint is agitated by means of a stirring stick or a motor-driven agitator of the kind which comprises a rotatable shaft with an impeller. However, such a paint agitation is not always completely reliable, and an apparatus for carrying into effect such paint agitation (see U.S. Pat. No. 4,095,288, U.S. Pat. No. 4,112,518, GB 1,348,603 and GB 2,062,481) has a number of disadvantages which make them unacceptable for industrial use, for agitation or mixing of paint. Among said disadvantages, it could primarily be mentioned, that the stirring stick or mixer becomes stained with paint, and that if present, an apparatus detail which covers the opening of the paint container, becomes stained with colour and therefore must be cleaned between different mixing operations. Other disadvantages are that at least some of the known apparatuses have an own vessel for the paint, and this means that the apparatus vessel must be cleaned between mixing operations with different paint colours, and furthermore the paint container (can) must be carefully emptied in connection to the transfer of the content thereof to the apparatus vessel, and then, of course, the apparatus vessel must also be carefully emptied after the mixing operation. In the extent the known apparatuses have an apparatus lid for closing the container or the vessel, this lid must also be cleaned between the mixing operations, and in the extent the known apparatuses do not have such a lid, there is severe risk that paint is thrown around during the mixing operation. A common feature for the above mentioned group of known apparatuses for mixing of paint or the like by stirring the paint by means of a stirring stick or the like, is that the mixing operations require long time and are labour intensive, especially in view of necessary cleaning work.

Therefore, since long time ago, a mixing apparatus of the type revealed in see GB 1,586,953 has been utilized in industrial applications. Such a mixing apparatus has among other things the advantage to offer an agitation of the paint in a closed can, that is the can in which the paint is delivered from the factory, without the need of agitation sticks or the like, and the can is closed with its lid. However also apparatus of this type have some disadvantages.

In order that an apparatus of the type at issue shall be industrially acceptable, it must be adaptable to differently container sizes and different paint amounts in a relatively wide interval, for example cans from one liter to five liters. Such cans or containers have various designs depending on producer, but usually they consist of thin-walled tin containers which usually have the shape of a right circular cylinder. If the apparatus subjects the can for shaking movement which has substantial movement components across the axial direction of the can, it is necessary to strongly clamp the can axially in order to prevent the can from becoming displaced in said cross direction. For practical reasons, the clamping is arranged between parallel clamping plates, because the apparatus must be able to cope with cans of very differently sized and shaped cross-section areas. In any case the can clamping force is delimited by the low strength of the can.

Another disadvantage with the machine according to GB 1,586,953 is that the shaking movement occurs in a single plane, and this means a risk for insufficient agitation of the content of the can in directions which intersect said plane.

It is true that machines are known at which the can is orbited in a circular path with large radius, and at which the can simultaneously it rotated with another rotational velocity around its own axis, but such machines require unacceptable space and cannot work with effectively high rpms due to the risk that the can is crushed at required axial clamping in the apparatus.

Another disadvantage with the machine known from GB 1,586,953 is that the transfer of power of from the drive engine of the apparatus into paint stirring power, is relatively low.

An object of the invention is therefor to provide an apparatus which maintains the advantages of apparatuses of the type which is known from GB 1,586,953, and which reduces or eliminates the disadvantages of the known apparatus type.

CHARACTERIZATION OF THE INVENTION

The present invention is based on an apparatus for agitating the content of a closed package having an axis such as a paint can, comprising a frame, a substantially vertically oriented package holder, which is movably mounted in said frame, said holder comprising means for releasable clamping of the package with the axis of the package in parallel to the axis of the holder, and means for driving the holder with a rotational speed of at least 100 rpm in a closed movement path related to the frame. On the basis of these previously known apparatus features, the inventive apparatus is characterized by the novel features that the drive means comprises a substantially vertically oriented rotatable drive shaft, which is mounted centrally on the frame and which carries a crank having a substantially vertically oriented crank pin which is centrally connected to the lower portion of the holder, said pin being at one of its ends journalled on a bearing, and that stabilizing means which connect between the holder and the frame, are arranged to prevent the holder from rotating around the axis thereof, and to hold the axis of the holder converging toward the axis of the drive shaft in direction upwardly from the pin.

The drive shaft is the output shaft from an electrical motor, the housing of which is fixedly mounted to the lower central portion of the frame with the drive shaft directed upwardly. This stabilizing means comprises elastic means which are connected between the holder and the frame at the level of minimum distance between the holder axis and the shaft axis. In another embodiment the stabilizing means could comprise a second shaft which is mounted on the frame and which is coaxial to the drive shaft, and another crank which is connected to said second shaft, and having a pin which is centrally connected to the upper portion of the holder, the pins of said cranks being substantially coaxial, said cranks being mutually angularly displaced substantially 180°.

The inventive apparatus has turned out to provide a high degree of power transfer from the drive shaft to material agitation. The machine can operate with cans in a relatively large size range. The apparatus does not set any specific demands on the environment, as the vibrations which are transferred to the stand of the apparatus are relatively small and harmless. The apparatus is structurally simple and efficient.

Other advantages of the invented apparatus have been mentioned above or will be mentioned in the following or realized by the artsman.

Embodiments of the invention will now be described with reference to the appended drawing.

DRAWING

FIG. 1 shows schematically an elevation view of an apparatus according to the invention.

EMBODIMENTS

Figure 2:
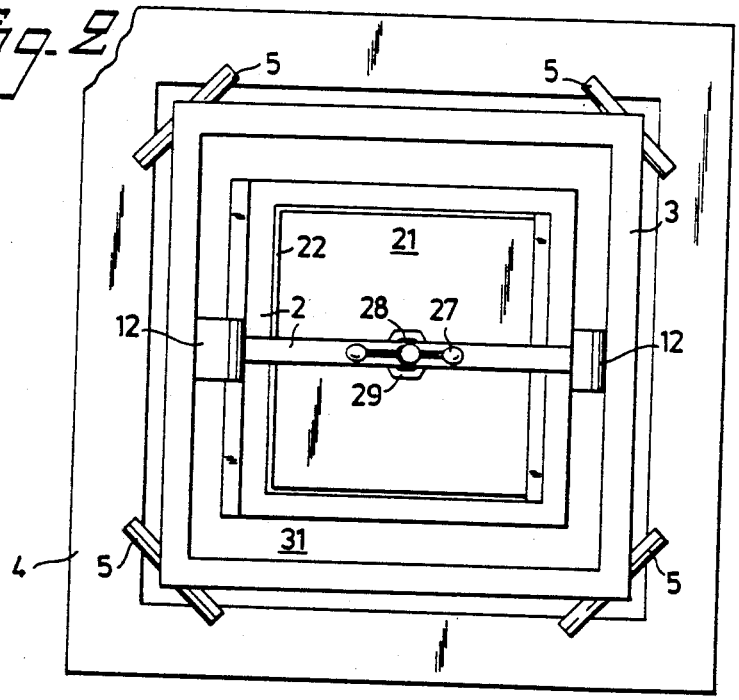
FIG. 2 shows a horizontal view taken along line II—II in FIG. 1.

On FIG. 1 of the drawing there is shown a frame 2 with a holder for can 1. The frame 2 supports a lower plate 22 on which the can 1 is put. At the upper portion of the frame 2 there is a mechanism for clamping the can 1 against the plate 22. The mechanism comprises a fixed nut 29 which threadably receives a screw 26 which is provided with a handle 27 for rotation. A locking nut 28 is threaded on the screw 26 above the fixed nut 29. The lower end of screw 26 is via a rotational joint connected to the upper clamping plate 21 which acts on the upper end of the can 1. The can holder frame 2 is surrounded by an outer frame 3 which via elastical elements 5 is supported by a stand 4 which can stand on a base such as a flor. The outer frame 3 has a bottom plate 3 with a central opening. A motor 6 is fixedly mounted on the lower side of the plate 31 and the rotatable axle shaft 7 of the motor extends upwardly through the opening of the plate 31. The axis direction of shaft 7 is indicated with $A_1$.

The holder frame 2 is in the upper portion thereof connected to the outer frame 3 via elastical elements 12 at a level N.

The axle shaft 7 of the motor 6 carries a generally radial arm 8 which via a spherical rolling bearing 9 receives a shaft pin 10 which is connected to the lower side of the holder frame 2. A normal direction to the bottom plate 22 of the holder frame 2, said direction normally coinciding with the axis of the pin 10, is designated $A_2$ and is arranged to converge toward the axis $A_1$, and to have a minimum distance from this axis at the level N. Preferably the axes $A_1$ and $A_2$ are arranged to intersect in the region of the uppermost portion of the holder frame 2, and then the support means 12 should lie in a normal plane to the axis $A_1$ at the location of the minimum distance between the axes $A_1$ and $A_2$.

The axle shaft 7 of the motor 6 is provided with a counterweight 11 which is positioned diametrically opposite the crank arm 8.

The clamping position of the can 1 in the can holder 2 is not critical, but the can 1 should preferably be centered related to the axis $A_2$.

The operation of the apparatus is as follows.

When the motor 6 is activated, the pin 10 orbits in a horizontal path around the axis $A_1$ while the upper central portion of the holder frame 2 stands substantially still. The axis $A_2$ of the holder frame 2, and also the axis of the can 1, which is parallel to $A_2$, moves along a conical path around the axis $A_1$. The content of the can 1 could be considered as a mass which has a relatively high inertia and is subjected to a rotation around the can axis related to the can. At the same time the can content is subjected to a radially outwardly directed acceleration, which varies along the height of the can. Hereby the flowable content of the can or container can move upwardly from the lower outer portion of the can in direction upwardly toward the level N, and then radially inwardly and axially downwardly.

Suitably the rpm of the motor 6 is constant, and suitably the counter-weight 11 is a fixedly mounted apparatus component. Moreover the eccentricity of the bearing 9 is constant related to axis $A_1$. It is appreciated that different sizes and mass for cans 1 produce differrent radial forces against the support elements 12. Because the elements 12 are elastical, the location for minimum distance between the axis A2 and $A_1$ can be displaced vertically. Hereby the transfer of vibration to the outer frame 3 is minimized, so that simple rubber elastical elements 5 can be used for supporting the outer frame 3 on the stand 4 whereby the risk is minimized that the outer frame 3 should be subjected to vibration resonances related to the stand 4, and at a minimum risk that the apparatus should fall over or that harmful vibration should be transferred via the stand 4 to the base for the stand. As mentioned the apparatus is preferably arranged so that the axes $A_1$ and $A_2$ intersect each other and thus lie in a common plane. Certain flowable material, for example such materials which contain relatively heavy particle-shaped components which are suspended in or shall be suspended in a liquid component, produces such a force pattern in the apparatus, that the axes $A_1$ and $A_2$ no longer intersect each other. The operation and efficiency of that apparatus will however be changed substantially by this mutual displacement of the axis $A_1$ and $A_2$ during operation of the apparatus.

Because the bearing 9 is a sperical roller bearing the pin 10 could without any inconvenience change direction relative to the axis $A_1$ during the starting period and stopping period of the apparatus. When the apparatus has taken a stable operation, the direction of the pin 10 is constantly related to the bearing 9.

The motor 6 stabilizes the outer frame 3 so that the inertial point of the motor 6 lies at a level below the support element 5 of the frame 3.

In a tested embodiment of the invention, the largest free height of the can holder 2 between the plates 21, 22 is about 250 mm. Two diametrically opposed rubber elements 12 are positioned at the upper level of the plate 21. The elements 12 consist of tubular horizontal axis parallel rubber elements. The motor 6 had a weight 8.5 kg and the inertial point thereof was located about 10 cm below the bottom plate 31. The operational running speed of the motor was 1450 rpm. The eccentricity of the bearing 9 related to the motor axis $A_1$ is 10 mm. The counterweight 11 had a mass of about 1 kg, and the inertial point thereof was located at a distance of 37 mm from the axis $A_1$. The apparatus according to the mentioned design in intended for cans in the interval 1 to 5 liters, that is cans with a mass in the range from about 1.5 to about 7.5 kg. No substantial vibrations were transferred to the stand 4 for any can in the interval, and no dangerous movements occured during the starting period or stop period of the apparatus.

The motor power was high during the operation of the apparatus, and this can be seen as an indication that the material contained in the can 1 was subjected to a powerful agitation or mixing. The apparatus according to GB 1,586,953 provides a comparatively much lower agitation power.

In order to achieve an effective agitation of the content of the can, probably a high rpm is required, which probably should be higher than 500 rpm and preferably be at least 1000 rpm.

The content of the can 1 is subjected to a rotational movement around the can axis, and is subjected to an orbit movement in the vertical plane. The composite movement for the paint in the can produces a fully acceptable mixing homogenizing or agitation of the paint.

While it is preferred to let the support elements 12 be of a rubber elastical material in order to permit a horizontal relative movement between the frames 2 and 3 at the upper portion of the can holder frame 2, it should be clear that a minimum distance between the axis $A_1$ and $A_2$ could be maintained with other means.

In the apparatus according to FIG. 1 it is preferred to arrange the level N at a point about the uppermost position of the plate 21 so that the content of the can tends to move upwardly along the entire height of the mantle wall of the can. Hereby the required mixing time ane the mixing effect will be comparable for cans of different height.

Because the axes $A_1$ and $A_2$ are mutually non parallel, as explained above, that is converge towards each other in direction upwardly, a vertical agitation of the can content is achieved, and moreover the centrifugal forces against the can are minimized. The last mentioned circumstance reduces the necessary axial force for clamping of the can in the holder 2, whereby the motor rpm can be chosen higher, or the eccentricity of the bearing 9 can be chosen higher than if the shafts $A_1$ and $A_2$ were parallel, because the axial crushing resistance of the tin can 1 usually is the dimensioning factor for the axial clamping force in the holder 2, and therefore is the dimensioning factor for holding the can in radial direction.

Above the invention has been described as an explicit embodiment, but it should be clear that the apparatus could be modified by simple means to be operable for a can size range of for example from 5 to 25 kg.

It should also be clear that then level N for minimum distance (intersection point) between axes $A_1$ and $A_2$ could be located between the bottom plate 22 and the lower limit position of the top plate 21 for the can interval at issue. Furthermore (see FIG. 3) it is possible to replace the lateral support elements 12 by a crank arrangement 7'–11' corresponding to the elements 7–11 between the upper central portions of the frames 2 and 3 said two crank arrangements being mutually phase displaced 180° so that the intersection point between the axes $A_1$ and $A_2$ lie at a level corresponding to half the height of the outer frame. Then the upper and the lower crank arrangement are mutually syncronized. The syncronization could be provided by means of a mechanical connection of the two crank arrangements. Possibly the upper crank arrangement 7'–11' could be provided with a separate own drive engine 6' corresponding to the motor 6 shown on FIG. 3.

The can clamping mechanism has been shown to consisting of an upper clamping plate with a screw arrangement, but it should be clear that other can clamping mechanisms can be used, for example such mechanisms which attack against the upper rim area of the can, for example against the peripheral region of the can lid.

Apparatus embodiments wherein the intersection point between the axes $A_1$ and $A_2$ will lie approximately at half the height of the can 1 are suitable especially for very tall cans or containers, for example cans with a height of 1 meter or more, and a width which for example is at the most half the height.

The plates 21, 22 are usually parallel, and usually the end surfaces of the cans or containers are parallel.

Figure 3:
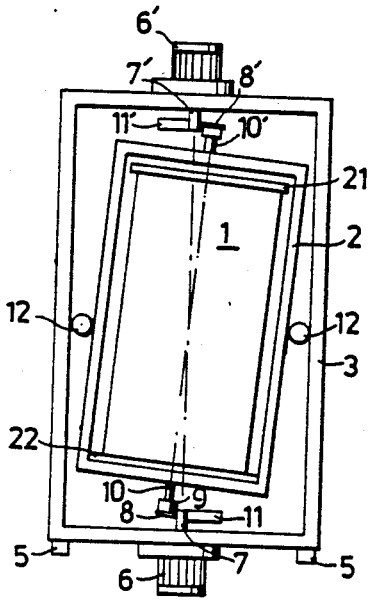
FIG. 3 shows schematically a central portion of another embodiment of the invented apparatus.

In the embodiment according to FIG. 3, universal joints or rubber elements corresponding to the elements 12, for example, connect between the frames 2 and 3 in order to ensure that the holder frame 2 is prevented from rotating around its axis.

We claim:

1. Apparatus for agitating the content of a closed package having a package axis comprising a frame, a package holder which is movably mounted in the frame, said holder having an axis and comprising means for releasably clamping the package with the package axis in parallel with the axis of the holder, and drive means for orbiting the lower portion of the holder in a closed movement path relative to the frame, wherein the drive means comprise a substantially vertically oriented rotatable driving shaft which is mounted centrally on the frame, said driving shaft having an axis and carrying a crank having a pin which is centrally connected to the lower portion of the holder, the axis of said holder converging toward the axis of said drive shaft in a direction upward from the pin, said pin being at one end thereof journalled in a bearing, the drive shaft being an output shaft of an electric motor, a housing of which is fixedly mounted on a lower central portion of the frame with the drive shaft directed upward, and stabilizing means located between the holder and the frame and being arranged to prevent the holder from rotating around the axis of the holder, and to hold the axis of the holder converging toward the axis of the drive shaft in a direction upward from the pin, the stabilizing means comprising elastic means which are connected between the holder and the frame at the level of a minimum distance between the axes of the holder and the drive shaft.

2. Apparatus for agitating the content of a closed package having a package axis comprising a frame, a package holder which is movably mounted in the frame, said holder having an axis and comprising means for releasably clamping the package with the package axis in parallel with the axis of the holder, and drive means for orbiting the lower portion of the holder in a closed movement path relative to the frame, wherein the drive means comprise a substantially vertically oriented rotatable driving shaft which is mounted centrally in the frame, said driving shaft having an axis and carrying a crank having a pin which is centrally connected to the lower portion of the holder, the axis of said holder converging toward the axis of said drive shaft in a direction upward from the pin, said pin being at one end thereof journalled in a bearing, and stabilizing means located between the holder and the frame and being arranged to prevent the holder from rotating around the axis of the holder, and to hold the axis of the holder converging toward the axis of the drive shaft in a direction upward from the pin, the stabilizing means comprising a second shaft which is mounted on the frame and which is coaxial with the first mentioned driving shaft, and a second crank which is connected to the second shaft and has a pin which is centrally connected to an upper portion of the holder, the pins of said cranks being arranged substantially coaxial and the cranks being mutually angularly displaced substantially 180°.

3. Apparatus according to claim 1 wherein said drive means is capable of orbiting the lower portion of the holder with a rotational speed of at least 100 rpm.

4. Apparatus according to claim 1 wherein said driving shaft has a counterweight attached thereto and positioned diametrically opposite to said crank.

5. An apparatus for agitating the content of a package comprising:

a frame;

a package holder movably mounted in said frame, said package holder having an axis and including mounting means for mounting a package therein;

drive means associated with said holder for orbiting a portion of the package holder relative to the frame, said drive means including a driving shaft which has an axle, the axis of said package holder being inclined with respect to said frame and the axis of said driving shaft and said drive means being adapted to orbit said package holder such that a portion of said package holder axis orbits relative to said frame and around the drive shaft axis; and stabilizing means located between the package holder and the frame to prevent the holder from rotating around the holder axis, said stabilizing means comprising a second shaft which is mounted on the frame and which is coaxial with the first mentioned driving shaft, and a second crank which is connected to the second shaft, said second crank including a pin which is centrally connected to an upper portion of the package holder, the pins of said cranks being arranged substantially coaxial and the cranks being mutually angularly displaced substantially 180°.

6. An apparatus according to claim 5 wherein said stabilizing means comprises elastic members located at a position of minimum distance between the package holder axis and the driving shaft axis.

7. Apparatus according to claim 5 wherein said driving shaft has a crank attached thereto, said crank having a pin which is centrally connected to a lower portion of the holder.

8. Apparatus according to claim 5 wherein said driving shaft has a counterweight attached thereto and positioned diametrically opposite to said crank.

* * * * *